United States Patent [19]

Paraskevas

[11] Patent Number: 4,480,796

[45] Date of Patent: Nov. 6, 1984

[54] PULPING APPARATUS INCLUDING IMPROVED ROTOR

[75] Inventor: Stavros Paraskevas, Pittsfield, Mass.

[73] Assignee: Beloit Corporation, Beloit, Wis.

[21] Appl. No.: 342,346

[22] Filed: Jan. 25, 1982

[51] Int. Cl.[3] ..... B02C 13/18

[52] U.S. Cl. ..... 241/46.11; 241/46.17; 241/79

[58] Field of Search ..... 241/46 B, 46.11, 46.17, 241/73, 46 A, 82.5, 293, 294; 366/262, 263, 265, 264

[56] References Cited

U.S. PATENT DOCUMENTS

| | | | |
|---|---|---|---|
| 2,649,882 | 8/1953 | Chopieska | 241/82.5 X |
| 3,073,535 | 1/1963 | Vokes | 241/46 |
| 3,774,853 | 11/1973 | Seifert | 241/46 |
| 3,847,360 | 11/1974 | Seydelmann | 241/82.5 |
| 3,889,885 | 6/1975 | Couture | 241/46 |
| 4,109,872 | 8/1978 | Couture | 241/46 |

*Primary Examiner*—Mark Rosenbaum
*Assistant Examiner*—Timothy V. Eley
*Attorney, Agent, or Firm*—Hill, Van Santen, Steadman & Simpson

[57] ABSTRACT

An improved pulping apparatus having a rotor with a special vane design providing improved defibering action as well as improved circulation. The rotor cooperates with a perforated extraction plate and has a plurality of outwardly extending vanes each having a surface arranged to cooperate with the perforated extraction plate, a smoothly contoured airfoil surface which receives the stock, a leading face and a trailing surface, the leading face having a concave trough-like surface extending for substantially the entire length of the vane.

7 Claims, 5 Drawing Figures

PULPING APPARATUS INCLUDING IMPROVED ROTOR

BACKGROUND OF THE INVENTION

1. Field of the Invention

This invention is in the field of pulping assemblies for defibering papermaking stock, particularly of high consistency. The improved pulping rotor of the present invention provides effective defibering at low power consumption as well as minimizing cavitation in the stock at high consistencies.

2. Description of the Prior Art

The traditional pulper rotor has two separate functions, first, defibering the stock suspension and second, efficient circulation of the suspension to keep it homogeneous.

There have been some disclosures in the prior art of pulping apparatus wherein stock to be pulped is introduced into a tub which is provided with a vertical axis rotor. The geometry of the rotor is such that it causes circulatory movement of the stock which causes more efficient circulation of the stock and also improves the pulping characteristics when the stock is forced between the rotor and an underlying extraction surface.

In U.S. Pat. No. 3,073,535 there is described a pulping apparatus including a rotor with vanes which project outwardly in overhanging relation with an underlying perforate bedplate. The vanes are provided with leading edge surfaces which are inclined toward the plane of the working surface between the rotor and the bedplate to force the stock into the stock working space and also to produce a rubbing action on the stock between the vanes.

In U.S Pat. No. 3,774,853 there is described a pulping device including a vaned rotor in which some of the vanes are equipped with cutter bars arranged to move past stationary bars in shearing relation. The fibers are cut by causing them to fold over the leading edge of the moving cutter and its associated vane. Each of the vanes is equipped on the surface opposite the cutter with one or more fins arranged to hold the folded over pieces of stock against centrifugal travel outwardly of the vane, thereby retaining the material in folded over position over the leading edge of the vane and the cutter until the cutter reaches the next stationary cutter where it is cut into two pieces.

U.S. Pat. No. 3,889,885 is said to be an improvement on the rotor assembly shown in Pat. No. 3,073,535. The thickness of the defibering vanes is reduced to minimize the pumping action, and separate pumping vanes are provided on the outer surfaces of some of the defibering vanes to increase the circulation effect created by the rotor during operation.

Another pulping rotor is described in U.S. Pat. No. 4,109,872. This rotor has spaced vanes each of which includes a defibering portion and a pumping portion. The defibering portion constitutes the outer end of the vane and is of relatively small axial dimension. The pumping portion has greater axial dimensions and an upper surface of convex airfoil shape. The leading face of each pumping portion is essentially planar and is inclined forwardly to overhang the trailing edge of an adjacent pumping portion so that between them they define a groove in which the stock is channeled for centrifugally outward flow. The rotor is designed to cooperate with a frustoconical extraction plate, and the defibering vane portions have their undersurfaces inclined to match the inclination of the extraction plate.

While pulping rotors of various forms have been described in the prior art, such rotors normally represent a compromise between efficient defibering and efficient circulation. Those rotors which use straight vanes approximating a radial configuration have excellent attrition characteristics but they are inefficient in pumping. Curved vanes provide better pumping efficiency but they lack the ability to efficiently defiber.

SUMMARY OF THE INVENTION

The present invention provides an improved rotor for a pulping assembly which is used for the defibering of waste paper, dry pulp furnishes, broke pulping, and the like, for either continuous or batch type operation. It provides effective defibering at low power consumption because of the geometry of the leading surface of the rotor vanes. The convex airfoil portion of the rotor provides a suction effect which provides a proper feeding to the following vane, thus minimizing cavitation at high stock consistencies.

In its broader aspects, the present invention provides a rotor for use in conjunction with an extraction plate for defibering liquid slurry stock and causing the defibered material to pass through the extraction plate, the rotor including a plurality of offset, outwardly extending vanes each having an extraction side, a stock side, a leading face and a trailing surface, the rotor further having a concave trough-like surface extending for substantially the entire length of each vane. The rotor further includes a surface on its leading face which is located adjacent the extraction side throughout the area of the vane which is to be positioned adjacent the extraction surface to provide an attrition angle of less than about 20°. In a preferred form of the invention, I make use of replaceable inserts in the forward portion of the vane to provide different angles of contact with the stock, depending on the consistency and nature of the stock being treated.

In a particularly preferred form of the invention, the rotor has a plurality of equally spaced vanes extending outwardly from a hub, each of the vanes including a leading edge with an upper portion having a generally circular forward edge of relatively small radius of curvature, the leading edge merging into a concave generally parabolic central portion of substantially less pronounced curvature than the forward edge. The central portion merges into a smooth surface bottom extraction surface arranged to be positioned in closely spaced relation with an extraction plate in the pulping tub. Each vane further has a smoothly contoured convex airfoil trailing surface extending from the generally circular forward edge to the trailing end of the vane, the airfoil trailing surface serving to feed stock to the leading edge of a succeeding vane without excessive cavitation.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
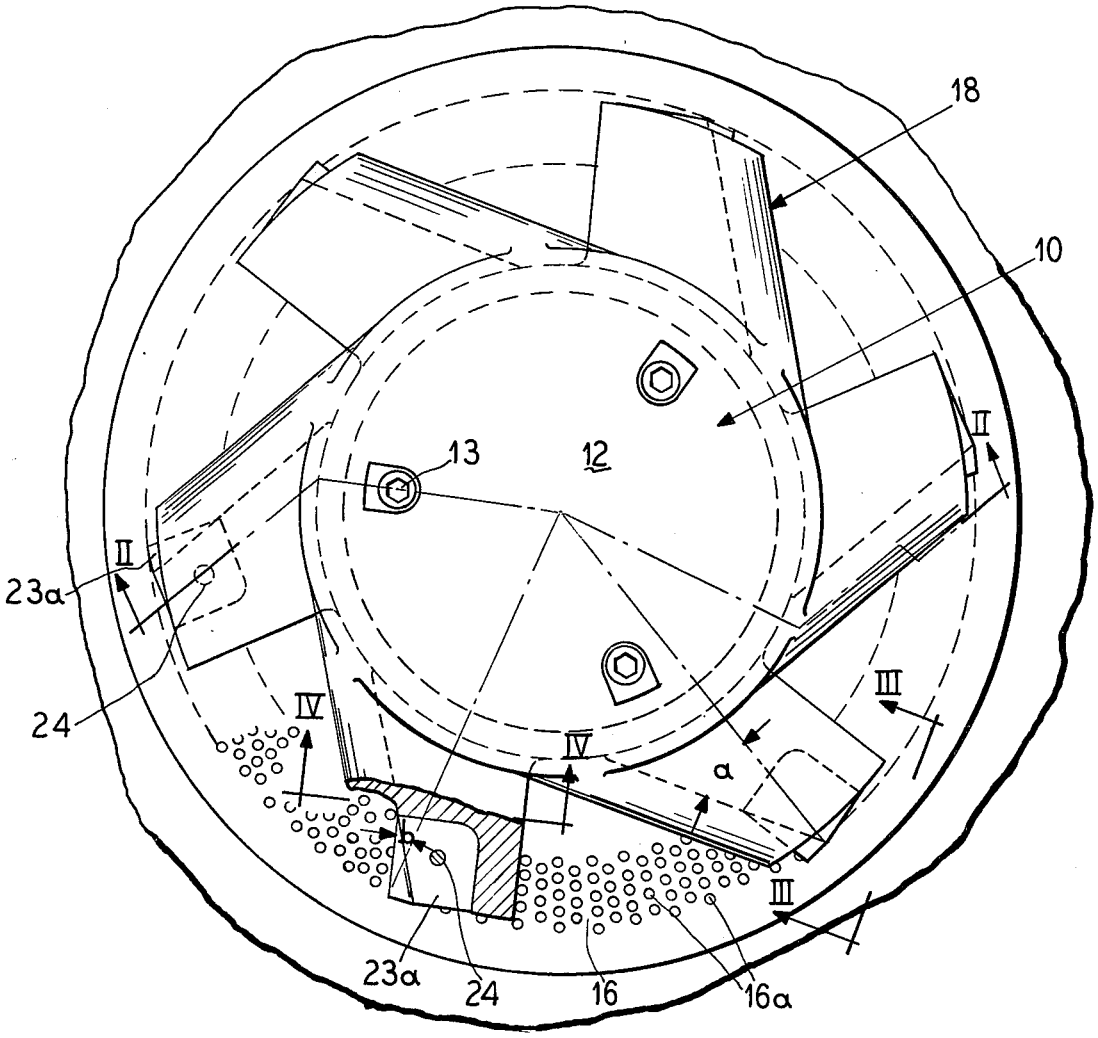
FIG. 1 is a plan view of a rotor assembly and extractor plate embodying the improvements of the present invention.
Figure 2:
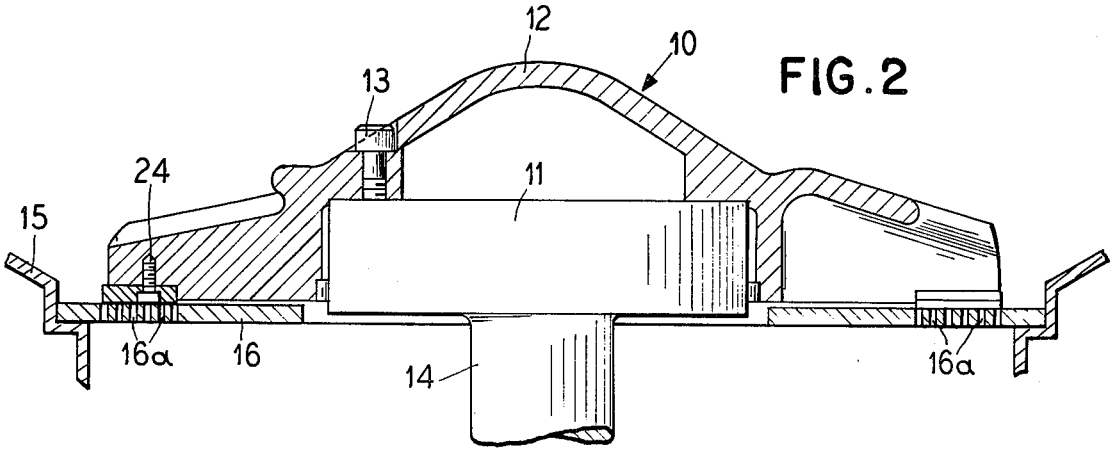
FIG. 2 is a cross-sectional view taken substantially along the line II—II of FIG. 1.

In FIG. 1, there is illustrated a pulping assembly including a rotor generally indicated at reference numeral 10. The rotor includes a hub 11 over which there is a smoothly contoured cover plate 12 or central body portion held to the hub 11 by means of spaced bolts 13. The rotor assembly is mounted for rotation by means of a shaft 14 from a driving source (not shown). The rotor assembly is mounted for rotation within a tub 15 and is arranged to cooperate with an extractor plate 16 having an annular band of apertures **16*a*** formed therein as best seen in FIG. 1.

Attached to the hub 11 are a plurality of equally spaced rotor vanes identified generally at reference numeral 18. Since the vanes are identical, a description of one will suffice for all. As best seen in FIG. 1, the vanes are secured to the hub with their major axes at an angle to a radius; and more particularly the vanes extend in a generally tangential direction from the central body portion 12. The specifics of the spatial relationships which form an important part of this invention will be discussed in a succeeding portion of this specification.

Figure 3:
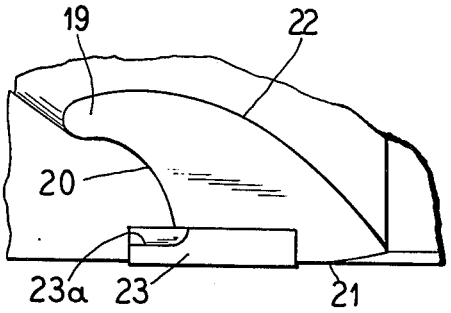
FIG. 3 is a fragmentary view taken substantially along the line III—III of FIG. 1.
Figure 4:
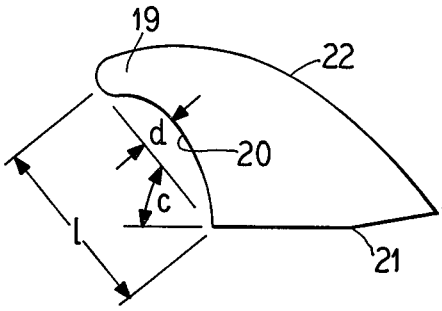
FIG. 4 is another fragmentary view taken substantially along the line IV—IV of FIG. 1.
Figure 5:
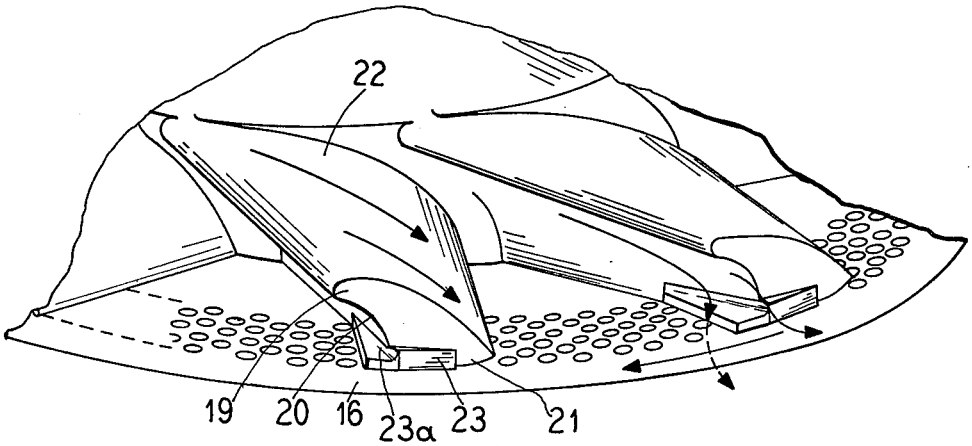
FIG. 5 is a fragmentary view in perspective illustrating the manner in which the improved rotor structure of the present invention facilitates defibering and also pumping of the pulp slurry.

The geometry of the blades is best illustrated in FIGS. 3 to 5, inclusive, of the drawings to which reference will now be made.

The leading face of each vane 18 includes an upper portion which has a generally circular forward edge 19 of relatively small radius of curvature. This forward edge 19, which extends substantially linearly in the generally tangential direction of the vanes 18 and merges into a concave, generally parabolic central portion 20 of substantially less pronounced curvature, i.e., a much larger radius of curvature than the curvature of the upper portion 19. The central portion 20 provides the stock side of the vane and merges into a smooth surfaced bottom face 21 which is arranged to be positioned in closely spaced relation with the extraction plate 16 as best seen in FIG. 5 and provides the extraction side of the vane.

Each vane further includes a smoothly contoured, convex airfoil trailing surface 22 extending from the generally circular forward edge 19 to the trailing edge of the bottom face 21. As indicated by the arrows in FIG. 5, the airfoil trailing surface 22 serves to feed stock to the leading edge of a succeeding vane 18. The forward edge 19 provides low frictional resistance to the flow of the stock, and the airfoil profile of the vane provides a suction effect which provides a proper feeding to the following vane, minimizing cavitation at high stock consistencies. In this connection, the design of the present invention is easily capable of handling stock consistencies of 6 percent on a bone dry basis, and can effectively defiber stock suspensions as high as 15 percent on a bone dry basis with high power efficiency.

At the intersection of the central portion 20 and the bottom extraction face 21, each plate is provided with a detachably mounted defibering blade 23. As best seen in FIGS. 3 and 5, the blade has a milled or otherwise relieved portion **23*a*. Each defibering blade can be selected to accommodate various furnish characteristics to provide the proper amount of attrition power. As best seen in FIG. 1, the forward edge of the blade 23 extends slightly beyond the outer periphery of each of the rotor vanes. Screws 24** may be provided to secure the replaceable defibering blades to the vane structure.

Next, considering the geometric relationships which should exist, the angle between the straight portion of the blade at the leading edge of the bottom face and a radius, identified as angle a in FIG. 1, is known as the pumping angle. For best results, I have found that this pumping angle should be at least 35° but should not exceed about 70°.

The angle identified at b in FIG. 1 is the attrition angle, and is the angle intercepted by the straight line portion of the leading face and a radius drawn to the extreme leading edge of a defibering insert 23. This angle should be no more than 20° and preferably is in the range of 5° to 20°.

Turning now to FIG. 4, the lead angle c is defined as the angle between the plane of the leading portion of the bottom surface 21 and the tangent to the forward edge 19. This angle should be less than 85°.

The maximum displacement d of the concave central portion 20 from the line joining the leading edge of the bottom surface 21 and a tangent to the upper portion 19 is a measure of the concavity of the leading face of the vane. The ratio between the displacement d and the distance 1 which is measured from the center of curvature of the forward edge 19 at a point on the bottom surface just behind the defibrating insert 23 is defined as the concavity ratio. For best results, this concavity ratio should be equal to or greater than 15% and preferably is in the range from 15 to 25%.

Referring to FIG. 5, the stock suspension is delivered into the tub from above where it strikes the generally circular forward edge 19 which, because of its rounded configuration, provides a low friction surface. The stock suspension which can include solids as high as 15% on a bone dry basis then proceeds along the contoured airfoil trailing surface 22 which provides a suction effect on the stock and delivers the stock suspension to the next succeeding vane, thus minimizing cavitation at high consistencies. The speed of rotation of the rotor assembly is sufficiently high to provide a peripheral velocity at the tips of the rotor vanes on the order of 3000 to 4500 feet per minute.

The concave central portion 20 traps the suspension in a spiral movement, with a high degree of defibering action, and entrains the suspension toward the blade 23. The bottom surface 21 and the blade 23 thereupon cooperate to pull the fibers apart and deliver them through the apertures in the extraction plate 16.

Tests have shown that the improved pulping rotor of the present invention provides improved efficiency in minimizing power consumption. When compared to commercially available machines in the defibering of newsprint, the amount of energy reduction measured in terms of horsepower per ton per day to achieve the same amount of defibering was about 40 to 50% less in the case of the improved pulping rotor of the present invention.

It should be evident that various modifications can be made to the described embodiments without departing from the scope of the present invention.

I claim as my invention:

1. A rotor for use in association with an extraction plate adapted for defibering liquid slurry stock and causing defibered material to pass through said extraction plate, said rotor comprising:

a central body portion;

a plurality of vanes extending in a generally tangential direction from said central body portion and each having an extraction side, a leading face and a trailing surface, the leading face of each vane including a generally circular convex forward edge of relatively small radius of curvature and which extends substantially linearly in said generally tangential direction, said forward edge merging into a concave central portion having a substantially larger radius of curvature than said small radius of curvature, said central portion merging into a smooth surfaced bottom face having a trailing edge, and a smoothly contoured convex airfoil trailing surface extending from said forward edge to the trailing edge of said bottom face.

2. A rotor as claimed in claim 1 wherein the angle between the plane of the leading portion of the bottom face and the tangent to said forward edge is less than 85°.

3. The rotor as claimed in claim 2 wherein each vane has a straight portion at the leading edge of said bottom face which makes an angle of at least 35° with a radius of said rotor.

4. A rotor as claimed in claim 1 wherein the ratio of maximum displacement of said concave central portion to the distance from the center of curvature of said forward edge to the leading edge of said bottom face is at least 15 percent.

5. A rotor as claimed in claim 1 wherein said trailing surface comprises a generally upwardly facing foil configuration for drawing slurry toward said extraction plate and into the path of the next succeeding leading face.

6. In a pulping apparatus including:

a tub, a rotor mounted for rotation about a vertical axis in said tub, and a perforate extraction plate disposed beneath said rotor for delivering defibered material therethrough, the improvement in the rotor structure which comprises:

a rotor hub, a plurality of equally spaced vanes extending in a generally tangential direction from said hub, each of said vanes including a leading face with an upper portion including a generally circular convex forward edge of relatively small radius of curvature and which extends substantially linearly in said generally tangential direction, said leading edge merging into a concave central portion of substantially less pronounced curvature than said small radius of curvature, said central portion merging into a smooth surfaced bottom face having a trailing edge and positioned in closely spaced relation with said extraction plate, each vane further having a smoothly contoured airfoil trailing surface extending from said generally circular convex forward edge to the trailing edge of said bottom face.

7. A pulping apparatus according to claim 6 which includes:

a detachably mounted defibering blade secured to each vane at the intersection of said central portion and said bottom face.

* * * * *